United States Patent [19]

Irvello

[11] Patent Number: 4,819,475

[45] Date of Patent: Apr. 11, 1989

[54] TOOL FOR ALUMINUM SIDING APPLICATORS

[76] Inventor: Mario M. Irvello, 3808 Landis Mill Rd., Collegeville, Pa. 19426

[21] Appl. No.: 81,337

[22] Filed: Aug. 4, 1987

[51] Int. Cl.[4] ..... B21D 22/04

[52] U.S. Cl. ..... 72/447; 72/36; 72/482; 83/522; 83/562

[58] Field of Search ..... 72/36, 446, 447, 479, 72/481, 482; 81/562, 743, 522; 493/1, 355, 396

[56] References Cited

U.S. PATENT DOCUMENTS

| | | | |
|---|---|---|---|
| 1,076,772 | 10/1913 | Lilleberg | 83/562 |
| 3,161,099 | 12/1964 | Comet | 83/562 |
| 3,384,941 | 5/1968 | Koike et al. | 83/562 |
| 3,668,956 | 6/1972 | Whipple et al. | 83/562 |
| 4,060,016 | 11/1977 | Gerber | 83/562 |
| 4,061,065 | 12/1977 | Arriola | 83/562 |
| 4,230,011 | 10/1980 | Battaglia | 83/562 |
| 4,544,367 | 10/1985 | Vossen | 493/1 |

*Primary Examiner*—David Jones

*Attorney, Agent, or Firm*—Frederick J. Olsson

[57] ABSTRACT

Equipment for aluminum siding applicators which has support and datum surfaces to receive, support, and align an aluminum trim strip to be punched with datum dimples and a spring biased punch which can be moved relative to the aluminum trim strip to any position where a dimple is to be made.

7 Claims, 2 Drawing Sheets

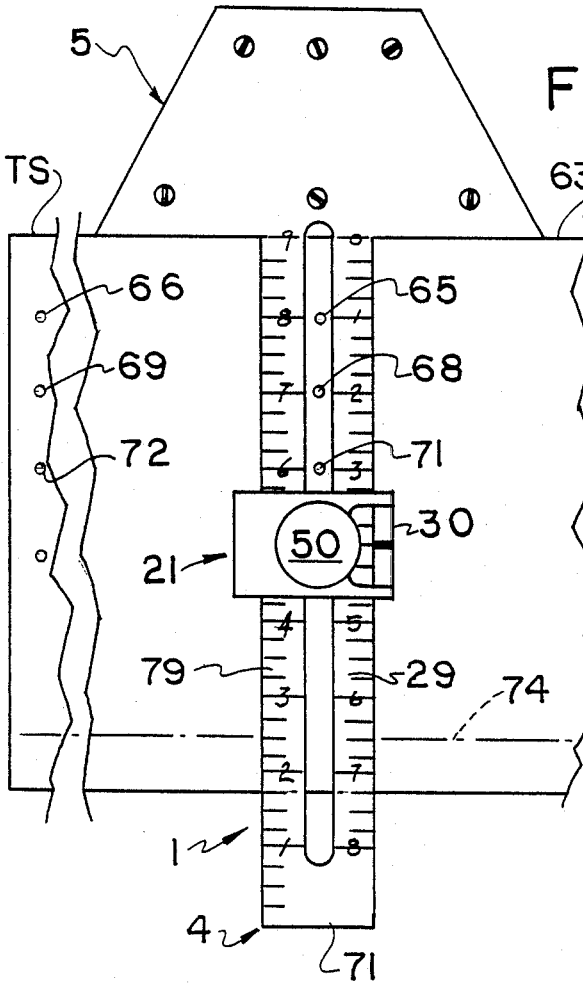
FIG. 8
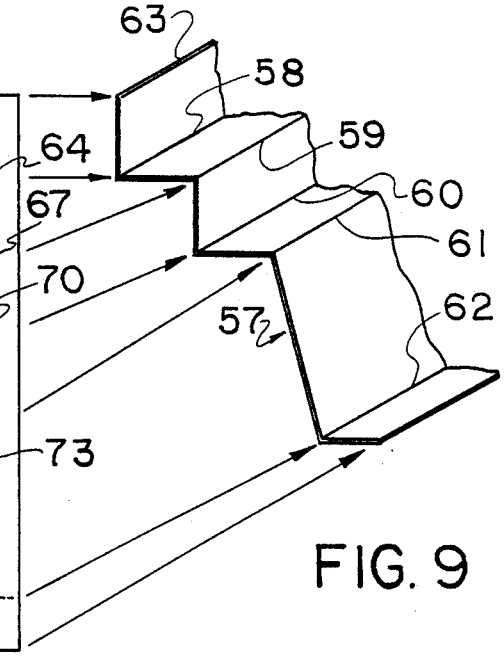
FIG. 9
FIG. 3
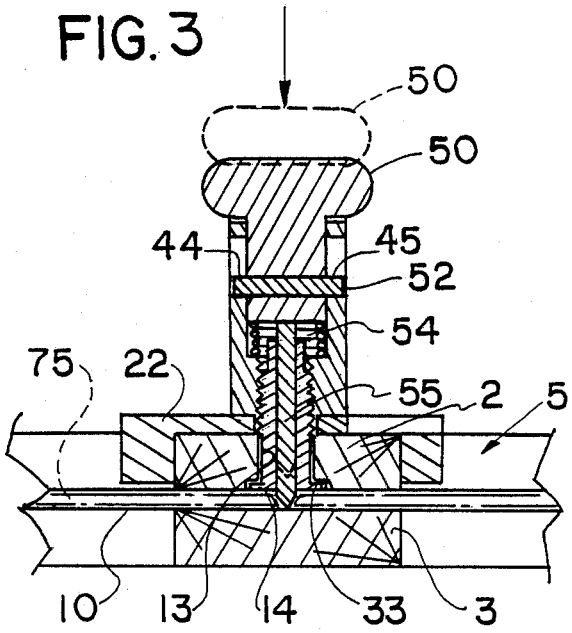
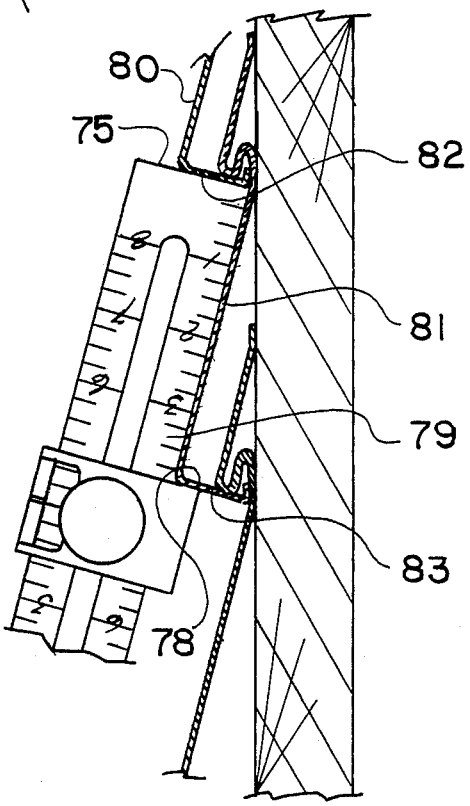
FIG. 10

TOOL FOR ALUMINUM SIDING APPLICATORS

This invention relates in general to building construction and repair. In particular, the invention relates to mechanism for use by applicators of aluminum siding, the siding including the aluminum sections which cover exterior side walls and the aluminum sections which comprise various types of trim.

More specifically, the invention relates to equipment for aluminum siding applicators for use in the rapid formation of datum dimples in flat aluminum strips which are brake-formed on-the-job into complex, reverse bend shapes for trim and, in the hand-held form, also for use in checking that the aluminum siding strips are properly aligned and interlocked.

The primary objective of the invention is to promote the useful art of aluminum siding application by means of equipment which greatly reduces application time and thereby effects substantial savings in labor costs.

It has long been conventional in the aluminum siding trade to custom fabricate trim such as for windows, corners, cornices, or other complex shapes right on the job by the use of a portable brake. The width of a strip having the required dimension to allow for the bends is calculated. The strip is then cut from a widewidth supply roll. This strip has to be provided with some kind of indicia so the strip can be properly set up in the brake for bending in the correct places. Usual methods for accomplishing this are to scribe lines by pencil or like on opposite sides of the strip or to lay the strip on a flat surface and mark dots at the appropriate places and then take a nail and hammer and place dimples (usually holes) at the dots.

The foregoing techniques are time-consuming and in many instances, when inaccurate, cause a duplication of the operation with not only a waste of time, but the waste of materials.

The present invention provides a means to put in the necessary dimples at a great savings of time and with accuracy.

According to the invention, the ecge of a strip of material is set up against a datum surface. Then a punch is accurately located over the strip at a fixed distance from the edge. Next, the punch is actuated to perform the dimple operation. The strip is shifted transversely so that the area where the next dimple is to be made is under the punch. The punch is actuated to make the next dimple. Normally, a dimple is made adjacent one end, one in the middle, and one at the opposite end.

When the shape of the trim requires multiple bends, the punch is relocated to make the second set of dimples, then relocated for the third set and so on. The relocation is effected simply by setting up the punch in accordance with a fixed scale which will locate the punch at a desired distance from the datum surface.

The description of the invention herein is done in connection with a hand-held tool. However, it will be evident that the device may be non-hand-held by that part of the device which comprises a work table.

In the siding trade, it has long been desired that the applicator check that each new piece of siding strip is appropriately interlocked and aligned with the siding strip already in place. This has either been done "by eye" or by using a ruler. The "by eye" approach is unsatisfactory and the use of a rule to be placed at several positions along the siding string is time-consuming particularly because of the necessity of visually ascertaining the dimension.

In the hand-tool form of the invention, the tool is provided with an exterior fixed abutment at one end and the means which locates the punch is also provided with an abutment. The latter can be quickly set so that the distance between the abutments corresponds to the width of the side strip; i.e. the distance between corresponding lower edges. Thus, it is only necessary to set the movable abutment (in accordance with a scale on the tool) and then place the tool so that the abutments respectively engage the lower ends of adjacent strips. The tool can be quickly moved along the siding strip and it can be quickly ascertained whether the adjacent strips have been properly interlocked and aligned.

The invention will be described below in connection with the following drawings wherein:

FIG. 3 is a view of the components of FIG. 2 in assembled condition and illustrating the punch in the inoperative position and just at the start of the dimpling operation.

FIG. 8 is a plan view to illustrate how the tool of FIG. 1 is mounted on the edge portion of an aluminum trim strip for punching datum dimples;

FIG. 9 is a fragmentary perspective view of the strip of FIG. 7 as bent into a complex shape with the assistance of the datum dimples; and FIG. 10 is a fragmentary view to illustrate how the tool of FIG. 1 is used to check that adjacent siding strips are properly aligned and interlocked.

The invention is disclosed herein in the form of a hand-held tool T. It will be readily appreciated as the description proceeds, that the tool may be non-hand-held where a part of the tool is in the form of a work table top. Also, it will be evident as the description proceeds that the spring bias for the dimple forming punch can be effected by locating the spring in a different environment as will be commented on more in detail later.

Figure 1:
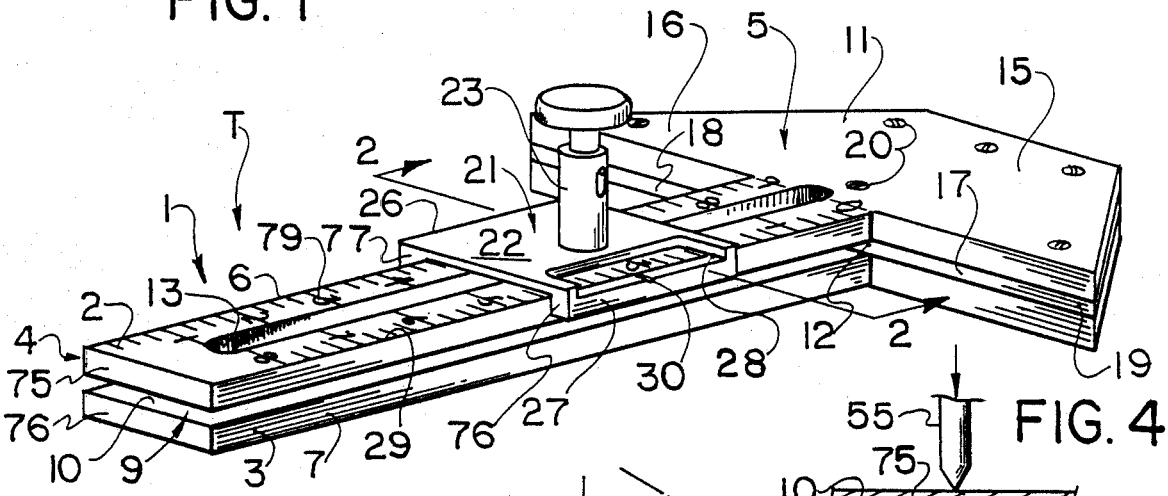
FIG. 1 is a perspective view of the invention in the form of a hand-held tool.

Referring to FIG. 1, an elongated body 1 has a rectangular shaped upper arm 2, and a parallel extending rectangular shaped lower arm 3. The two rectangularly shaped arms are spaced apart about ⅛" or a distance which is substantially greater than the thickest aluminum sheet used for trim. The body is open at the end 4, closed at the end 5, and open on the sides 6 and 7. The closed and open arrangement forms a slot 10 for receiving an aluminum trim strip indicated at TS in FIGS. 2, 3, and 8. The lower arm forms a support surface 10 for the trim strip in the slot 9.

While it is not shown, the body can be considered as having a straight axis which extends centrally through the slot 10 and out through the closed end 5.

The closed end 5 is formed as a head 11 having a datum surface 12 which is normal to the axis of the body 1 and is used to engage the edge of the trim strip TS.

Figure 2:
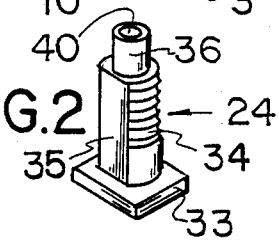
FIG. 2 is an exploded view taken along the lines 2—2 of FIG. 1.

The top arm 2 is formed with track means which, in this case, is an open channel 13. As seen in FIG. 2, the channel 13 has an enlarged section 14 which is adjacent to the receiving slot 10.

As will be evident, the head 11 is formed with two wings or extensions 15 and 16 which extend outwardly from the body 1 and have datum surfaces 17 and 18 which are respectively coplanar with datum surface 12. The datum surface 17 and 18 are for engaging the edge of the aluminum strip.

When the datum surfaces 12, 17, and 18 are engaged with the edge of the aluminum strip, the track or channel 13 extends at right angles to the edge.

In the embodiment shown, the body has a sandwich construction with the upper arm 2 and corresponding upper part of head 11 and the lower arm 3 and corresponding lower part of head 11 being separated by the intermediate layer 19. The assembly is held together by the screws 20.

The body 1 has a carrier assembly 21 which is interengaged with the track 13 and is adapted to be reciprocated back and forth along the track between the open and closed ends 4 and 5. The carrier assembly includes the slider 22, the upper assembly 23, and the lock stud 24.

Figure 6:
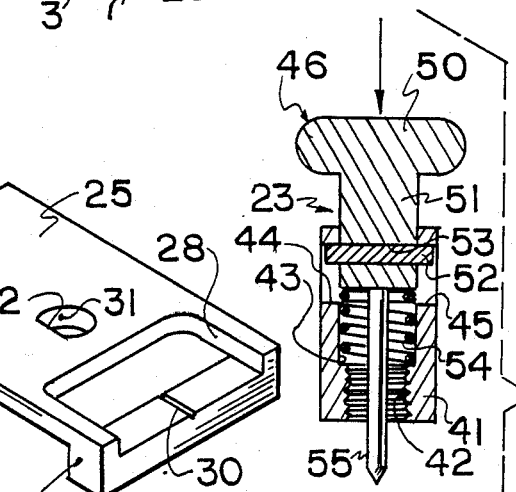
FIG. 6 is a perspective view of the slider component of the tool of FIG. 1.

The shape of the slider 22 is best shown in FIG. 6. The slider has a top 25 which slidably engages the top of upper arm 2 and extends across track 13. The slider has sides 26 and 27 which respectively slidingly engage the sides 6 and 7. The top 25 and side 27 are cut out at 28 which provides open space for viewing a scale 29 as will be noted later on. The side 27 has a marker 30 also for use with the scale 29. The top 25 of the slider has a clearance aperture 31 with a flat side 32.

The upper assembly 23 and the lock stud 24 cooperate to hold the carrier in any position along the track 13 and slidingly retain a punch for making the dimples in the aluminum strip. The foregoing will now be described in connection with FIGS. 2 and 3.

Figure 7:
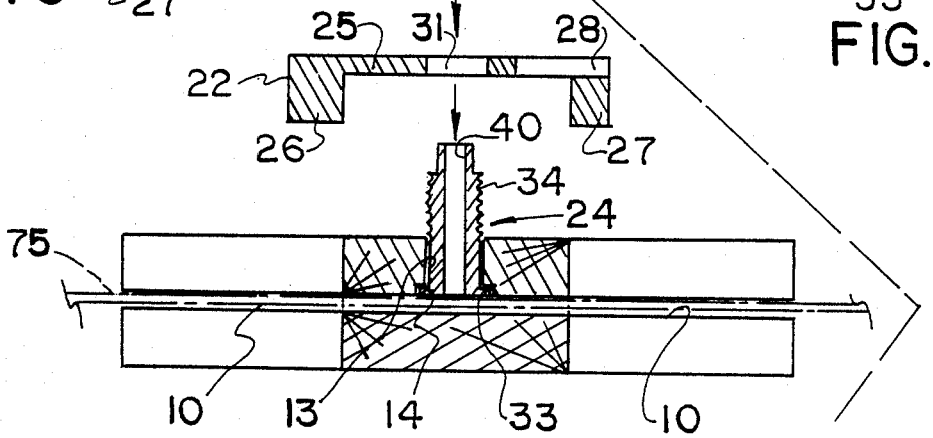
FIG. 7 is a perspective view of a locking stud used in the tool of FIG. 1.

The lock stud 24 (see FIG. 7) has a rectangular shaped head 33 exterior threads 34, a flat side 35, and reduced neck 36. A bore 40 extends through the stud. As will be seen with reference to FIG. 2, the head 33 is adapted to fit into the enlarged channel section 14.

The upper assembly 23 will now be explained.

A cylinder 41 has a lower threaded bore 42, enlarged central bore 43, and side retainer slots 44 and 45. An activator 46 includes an enlarged head 50 and a guide 51 which extends into the bore 43 and carries a pin 52 extending into retainer slots 44 and 45. The pin is press-fitted into an aperture 53 in the guide 51. A compression spring 54 in the bore 43 extends between the bottom of the bore and the lower end of guide 52. The spring urges the activator 46 upwardly with the upward motion being restrained by pin 52 engaging the tops of retaining slots 44 and 45. The stud 52 carries a punch 55 which extends down through the bore 40 and the stud 24.

The upper assembly 32 is put together as follows.

The spring 54 is put into the bore 43. Then the guide 51 is put down into the bore 43 until the aperture 53 is aligned with the retainer slots 44 and 45. Then the pin 52 is press fitted into place.

The manner in which the carrier assembly 21 is put together will next be desribed.

The stud 24 is oriented so that the head 33 can be moved down through the slot 13 and then is turned so that the head 33 is received in the enlarged channel section 14. The stud can be held up in the channel by inserting a piece of cardboard in the receiving slot 10.

Next, the slider 22 is placed down over the stud with the flat surface 32 engaging the flat surface 35. It will be seen that the stud 24 is prevented from turning by the head 33 in channel 14, by the engagement of the flats 32 and 35 and by the sides 26 and 27 engaging the upper arm 2.

The assembly 23 is now placed down over the slider 22 with the punch 55 in bore 40 and turned (usually with the fingers on head 50) so that the threads 42 engage the threads 34. The turning of the assembly is continued until the bottom of the cylinder 41 engages the top 23 of the slider 22. The foregoing pulls the head 33 into tight engagement with the channel section 14.

Thus, with the appropriate degree of turning, the carrier assembly 21 is prevented from sliding along the track 13. By turning the head 50 in the opposite direction, the engagement will be relieved and the carrier assembly 21 can be moved along the track 13.

It will be apparent, therefore, that the punch 55 can be moved to some desired position along the track 13 and held or locked in that position. The scale 29 is arranged with respect to the datum surfaces 12, 17, and 18 and the mark 30 related to the punch 55 so that the punch can be placed at known fixed distance with respect to the datum surfaces.

Figure 4:
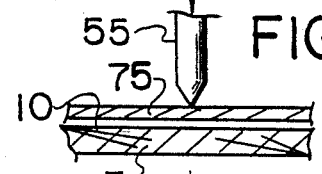
FIG. 4 is a fragmentary, diagramatic view showing the relationship between the punch and the aluminum strip just at the beginning of the dimpling operation.
Figure 5:
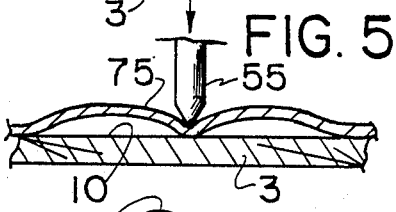
FIG. 5 is a fragmentary, diagramatic view showing the relationship between the punch at the aluminum strip at the end of the dimpling operation.
Figure 5:
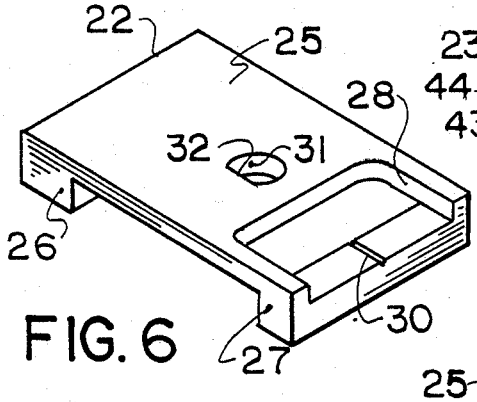

The forming of the dimples in the trim strip TS is represented diagramatically in FIGS. 4, and 5. In FIG. 4 the trim strip TS rests on the support surface 10 of the lower arm 3 and punch 55 has just engaged the top of the trim strip. As the punch 55 is moved down, it engages the trim strip and upsets the metal to form the dimple 56. The forming of the dimple temporarily, slightly raises the strip immediately around the dimple area of the support surface to allow the dimple to form. When the operation is completed, the strip, of course, remains flat. It will be noted that the concave part of the dimple is visable from one side of the strip and the convex part of the dimple is visable from the opposite side of the strip. These dimples provide indicia on both sides which is necessary when the strip is turned over for reverse bend forming.

Sufficient force can be applied to the head 50 to cause the punch to piece the trim strip. However, such extensive dimpling is not required.

The manner in which the tool is used for making dimples on a strip to be bent into a complex shape will be explained in connection with FIGS. 8 and 9.

Referring to FIG. 9, the cornice 57 includes several bends arranged at angles to each other. The cornice is formed from the flat strip TS shown in FIG. 8. The tool of the invention is used to form parallel rows of dimples, each row being at the desired distance from the edge of the strip so that the strip can be properly mounted in the brake to create the bends at the correct positions.

Referring to FIG. 9, assume that the bends 58, 59, 60, 61, and 62 are to be located respectively at 1", 2", 3", 4", and 7" from the edge 63 of the strip.

To make the dimples for the bend 58, the carrier assembly is moved until the marker 30 lines up with the 1" mark on the scale 29 and then is tightened up. The tool is then placed over the strip adjacent the right hand side with the datum surfaces 12, 17, and 18 engaging the edge 63. The head 50 is then depressed to form the dimple 64. The strip and/or tool are moved to place the tool in the center of the strip and then the head depressed to form the dimple 65. The tool and/or strip are moved so that tool is on the left hand side of the strip and the head 50 depressed to form dimple 66. The dimples 64, 65, and 66 form the datum points for making the bend 58 in the brake.

The carrier assembly 21 is then moved until the mark 30 is lined up with the 2" mark on the scale 29. The dimples 67, 68, and 69 are formed as explained for the dimples 64–66. The dimples 67–69 form the datum points for making the bend 59 in the brake.

The carrier assembly is then moved until the marker 30 is lined up with the 3" mark on scale 29 and the dimples 71, 72, and 73 are formed. These provide the datum points for making the bend 61 in the brake.

The carrier assembly is now moved to line up the marker 30 with the 4" mark on the scale 29 and the dimple 73 for the bend 61 is formed. Likewise the other two dimples for bend 61 are made in the strip. The dimples for the bend 62 are made along the line 74.

The use of the hand-tool embodiment of the invention to check for porper interlocking and alignment of adjacent rrim strips will now be explained.

The open end 4 of the body 1 has abutment means in the form of flat ends 75 and 76 of the upper and lower arms 2 and 3. The edges 26 and 27 of the slider 22 extend outwardly from the sides 6 and 7 and have flat surfaces which form abutments 77 and 78.

The top of the upper arm 2 has a scale 79. The zero indication of the scale 79 lies in a plane containing abutment 75 and 76.

It will be evident that by moving the carrier assembly 22, the abutment 78 can be lined up with any of the marks on scale 79.

In order to check the interlocking and alignment of adjacent side pieces, such as side pieces 80 and 81 in FIG. 10, the specified width of the side piece is set up on the scale 79 by moving the carrier assembly until the abutment 78 is in correct position such as at the 4" mark shown in FIG. 10. Then the tool is simply maneuvered so the abutment 75 (76) engages the bottom edge 82 of siding piece 80 and the abutment 78 engages the bottom edge 83 of siding piece 81 as shown in FIG. 10.

The tool can be quickly moved along the siding pieces while checking that the abutments 75 and 78 remain engaged. If, at some area, the abutments 75 and 78 do not remain simultaneously engaged, the two side pieces are not properly interlocked at that area.

In cases where the invention is applied in a non-bend tool mode, the lower carrier can be in the form of the top of a work table with the upper arm clamped or otherwise secured to the table. Also, it will be apparent that the spring bias for the punch can be provided by locating the spring in a pivoted joint between the upper and lower arms. The latter form can be used in the non-hand tool mode.

I claim:

1. An aluminum siding applicator's tool comprising:

an elongated body having a straight axis;

the body being open at one end, closed at the opposite end, and open on opposite sides to form a receiving slot extending along said axis to receive a portion of an aluminum trim strip to be punched with datum dimples;

the body being formed with track means extending along the body parallel to said axis;

the body, at the closed end, having a datum surface oriented perpendicular to said axis, the datum surface being for use in engaging the edge of the portion of said aluminum trim strip received in the receiving slot to orient said track means perpendicular to the edge of the aluminum trip strip;

a slider mounted on said body in engagement with said track means for reciprocating motion along the track means;

holding means on said slider to hold the slider in any desired position along said track means with respect to said datum surface;

punch means mounted on said slider for movement through the receiving slot to engage the portion of said aluminum trim strip in the receiving slot to punch a datum dimple in the trim strip and to be moved away from the trim strip when dimple forming operation is completed; and said body at the open end being formed with first abutment means and said slider being formed with second abutment means which extends outwardly from one side of said body and said first and second abutment means being for use respectively in engaging the lower edges of adjacent aluminum siding strips to gauge the distance between the lower edges.

2. The tool of claim 1 further including:

a first scale on the body extending along said axis and cooperating with said slider for use in positioning the slider a known distance from said datum surface; and a second scale on the body and extending along said and cooperating with said first and second abutment means for use in positioning said second abutment means a known distance from said first abutment means.

3. An aluminum siding applicator's tool comprising:

an elongated body having a straight axis;

the body being open at one end, closed at the opposite end, and open on opposite sides to form a receiving slot extending along said axis to receive a portion of an aluminum trim strip to be punched with datum dimples;

the body being formed with track means extending along the body parallel to said axis;

the body, at the closed end, having a datum surface oriented perpendicular to said axis, the datum surface being for use in engaging the edge of the portion of said aluminum trim strip received in the receiving slot to orient said track means perpendicular to the edge of the aluminum trim strip;

a slider mounted on said body in engagement with said track means for reciprocating motion along the track means;

holding means on said slider to hold the slider in any desired position along said track means with respect to said datum surface;

punch means mounted on said slider for movement through the receiving slot to engage the portion of said aluminum trim strip in the receiving slot to punch a datum dimple in the trim strip and to be moved away from the trim strip when the dimple forming operation is completed; and said body, at said closed end, being formed with at least one wing which extends outward of the body and has a surface co-planar with said datum surface.

4. An aluminum siding applicator's tool comprising:

an elongated lower arm and an elongated upper arm spaced from the lower arm, the arms extending along an axis and forming an open slot to receive a portion of an aluminum trim strip to be punched with datum dimples and when in said slot the trim strip being engagable with said lower arm;

an open channel formed in said upper arm and extending along said axis;

track means formed on said upper arm and extending along said axis;

a head disposed at one end of said arms and connecting the arms together and having a pair of wings respectively disposed on opposite sides of said axis;

a datum surface formed on said head and on said wings and oriented perpendicular to said axis, the datum surface being for use in engaging the edge of the portion of said strip received in the said slot whereby said track means and the edge of the strip are oriented normal to one another;

a slider mounted on said upper arm in engagement with said track means and extending over said open channel and moveable back and forth along the track means;

lock means operatively connected between said slider and said upper arm to lock the slider on the upper arm in a desired position or to unlock the slider whereby the slider can be moved back and forth along the track means;

punch means mounted on said slider for movement therewith and for movement through said open channel and said slot toward said lower arm and the portion of said strip in the slot to punch a datum dimple in the strip as the strip is engaged with the lower arm and for movement away from the strip and the lower arm when the dimple forming operation is completed; and means to move said punch means toward and away from said strip and said lower arm.

5. The tool of claim 4 wherein said lock means extends through said open channel and has portions respectively positioned on the top side of said slider and on the underside of the upper arm and further has means to move said portions to grip the slider and upper arm therebetween so as to lock the slider in position or to move said portions to relieve said grip whereby the slider is moveable back and forth along the track means.

6. The siding tool of claim 4 further including:

a scale formed in the top side of said upper arm;

an opening formed on said slider whereby the scale is viewable therethrough; and an indicator mark on the slider in close proximity to said scale.

7. An aluminum siding applicator's tool comprising:

an elongated lower arm and an elongated upper arm spaced from the lower arm, the arms extending along an axis and forming an open slot to receive a portion of an aluminum trim strip to be punched with datum dimples and when in said slot the trim strip being engagable with said lower arm;

an open channel formed in said upper arm and extending along said axis, the channel having an enlarged portion on the underside of the upper arm;

track means formed on said upper arm and extending along said axis;

a head disposed at one end of said arms and connecting the arms together and having a pair of wings respectively disposed on opposite sides of said axis;

a datum surface formed on said head and on said wings and oriented perpendicular to said axis, the datum surface being for use in engaging the edge of the portion of said strip received in the said slot whereby said track means and the edge of the strip are oriented normal to one another;

a slider mounted on said upper arm in engagement with said track means and extending over said open channel and moveable back and forth along the track means;

a slider opening in said slider, the slider opening having a flat section;

a lock stud extending through said slider opening and having a flat section engaging the flat section in the slider opening;

a head on said lock stud and disposed in said enlarged portion of said channel and the lock stud having external threads disposed above said upper arm;

a cylinder having internal threads engaging the external threads on said lock stud;

a compression spring in said cylinder, one end of which is fixed in the cylinder;

an activator slideably mounted in said cylinder and engaging the opposite end of said compression spring, the spring urging the activator in a direction outwardly of the cylinder;

a pair of retaining slots formed on opposite sides of said cylinder;

a retaining pin extending through said activator and into said retaining slots;

a punch connected to said activator and extending through said compression spring and through said lock stud; and the pin and retaining slots retaining the activator in said cylinder against the force of said spring and providing for the activator to be moved against the force of the spring to move the punch for said punching operation.

* * * * *